US005450176A

United States Patent [19]

Unemo et al.

[11] Patent Number: 5,450,176

[45] Date of Patent: Sep. 12, 1995

[54] DEVELOPING DEVICE WITH RIGID MEMBER TONER LIMITING MEANS

[75] Inventors: Kouji Unemo; Masahiko Maeda; Shoji Tomita; Masao Uyama; Masayuki Nakashima, all of Osaka, Japan

[73] Assignee: Mita Industrial Co., Ltd., Osaka, Japan

[21] Appl. No.: 235,696

[22] Filed: Apr. 29, 1994

[30] Foreign Application Priority Data

May 20, 1993 [JP] Japan ..... 5-117507

[51] Int. Cl.[6] ..... G03G 15/06

[52] U.S. Cl. ..... 355/245; 118/653

[58] Field of Search ..... 355/245, 251, 253, 259; 118/653, 656

[56] References Cited

U.S. PATENT DOCUMENTS 4,780,741 10/1988 Wada et al. ..... 118/653 X
4,903,634 2/1990 Ono et al. ..... 118/653
4,920,916 5/1990 Mizuno et al. ..... 118/653
5,054,419 10/1991 Itaya et al. ..... 355/253 X
5,085,171 2/1992 Aulick et al. ..... 118/653
5,289,237 2/1994 Hashizume et al. ..... 355/245

FOREIGN PATENT DOCUMENTS 63-16736 1/1988 Japan .
6-109789 9/1992 Japan .
4-295853 10/1992 Japan .

*Primary Examiner*—William J. Royer
*Attorney, Agent, or Firm*—Beveridge, DeGrandi, Weilacher & Young

[57] ABSTRACT

An apparatus for developing an electrostatic latent image which includes a developing agent application assembly and a limiting device for limiting the amount of the developing agent held on the surface of the developing agent application assembly. The limiting device is made of a rigid member such as a sheet glass and its one surface is brought into forced contact with the surface of the developing agent application assembly.

23 Claims, 6 Drawing Sheets

DEVELOPING DEVICE WITH RIGID MEMBER TONER LIMITING MEANS

FIELD OF THE INVENTION

The present invention relates to an apparatus for developing an electrostatic latent image into a toner image in an image-forming machine such as an electrostatic copying machine or a laser printer. More specifically, the invention is concerned with an apparatus for developing an electrostatic latent image, which is equipped with a driven developing agent application means which holds the developing agent on the surface thereof and carries it into a developing zone, and a limiting means which limits the amount of the developing agent held on the surface of the developing agent application means.

DESCRIPTION OF THE PRIOR ART

In order to develop an electrostatic latent image into a toner image in an image-forming machine, as is well known, there has widely been used an apparatus for developing an electrostatic latent image, which is equipped with a developing agent application means constituted by a roller or an endless belt that is rotated in a predetermined direction. Being rotated in a predetermined direction, the developing agent application means moves through a developing agent-holding zone, a developing agent amount-limiting zone and a developing zone successively. In the developing agent-holding zone, the developing agent supplied in a suitable manner is held on the surface of the developing agent application means. In the developing agent amount-limiting zone, the limiting means acts on the developing agent held on the surface of the developing agent application means to limit its amount to be applied to a required amount. In the developing zone, the developing agent is applied onto the surface of an electrostatic latent image carrier such as a rotary drum, which has an electrostatic photosensitive material on the peripheral surface thereof, and electrostatic latent image formed on the surface of the electrostatic latent image carrier is developed into a toner image. In order to accomplish favorable developing, it is important that the developing agent is held in an accurately required amount and sufficiently uniformly in the direction of width on the surface of the developing agent application means by properly limiting the amount of the developing agent held on the surface of the developing agent application means by using the limiting means.

Japanese Patent Publication No. 16736/1988 discloses an apparatus for developing an electrostatic latent image equipped with a limiting means which is constituted by an elastic rubber member that may be a synthetic rubber such as urethane rubber or silicone rubber. The elastic rubber member constituting the developing agent limiting means has one surface thereof or tip edge thereof that is brought into forced contact with the surface of the developing agent application means to limit the amount of the developing agent held on the surface of the developing agent application means to be a considerably small amount, whereby a thin layer of developing agent is formed on the surface of the developing agent application means.

According to the apparatus for developing an electrostatic latent image disclosed in Japanese Patent Publication No. 16736/1988, however, the limiting member constituted by an elastic rubber member arouses the following problems that must be solved. First, physical properties of the elastic rubber member considerably vary depending upon the temperature and humidity of the atmosphere, whereby the action of the elastic rubber member for limiting the developing agent varies correspondingly depending upon the temperature and humidity of the atmosphere. Hence, the thickness of the developing agent layer formed on the surface of the developing agent application means undergoes variations correspondingly. Second, due to nonuniformity in the modulus of elasticity of the elastic rubber itself, it becomes difficult to uniformalize the force of bringing the elastic rubber member into contact with the surface of the developing agent application means to a sufficient degree in the direction of width, and it therefore becomes difficult to uniformly form the thin layer of the developing agent on the surface of the developing agent application means to a sufficient degree in the direction of width. Third, the elastic rubber member usually has a low durability and is degraded within relatively short periods of time. Fourth, the elastic rubber member usually involves error in the properties such as in the modulus of elasticity and hardness, the error being made during the production. Therefore, it is not necessarily easy to stably produce the elastic rubber member having required properties.

SUMMARY OF THE INVENTION

A principal object of the present invention is to provide a novel and improved apparatus for developing an electrostatic latent image which is capable of forming, on the surface of a developing agent application means, a layer of the developing agent having a thickness limited to a predetermined value sufficiently precisely and being sufficiently uniform in the direction of width by limiting the amount of the developing agent held on the surface of the developing agent application means very properly as required, without using a limiting means made of elastic rubber and, hence, without arousing the above-mentioned problems that stem from the use of the elastic rubber member.

Another object of the present invention is to provide a novel and improved apparatus for developing an electrostatic latent image which is capable of stably forming a thin layer of the developing agent with a thickness of, for example about 20 μm on the surface of the developing agent application means in addition to accomplishing the above-mentioned principal object.

It has heretofore been considered as disclosed in the above-mentioned Japanese Patent Publication No. 16736/1988 that when the limiting means is constituted by using a rigid member, the layer of the developing agent formed on the surface of the developing agent application means becomes nonuniform to a striking degree making it far from being practicable. The present inventors, however, have conducted diligent study and experiments and have discovered the unexpected fact that the developing agent held on the surface of the developing agent application means can be limited as required and can be formed into a developing agent layer as desired when the limiting member is constituted by using a rigid member contrary to the conventional technical common sense and one surface of the rigid member is brought into forced contact with the surface of the developing agent application means.

That is, in order to accomplish the above-mentioned principal technical assignment, the present invention provides an apparatus for developing electrostatic image, which comprises:

a driven developing agent application means which holds the developing agent on the surface thereof in a developing agent-holding zone and carries the developing agent into the developing zone to apply it onto the electrostatic latent image;

and a limiting means which limits the amount of the developing agent held on the surface of said developing agent application means in a developing agent-limiting zone located between said developing agent-holding zone and said developing zone; wherein said limiting means is constituted by a rigid member of which the one surface is brought into forced contact with the surface of said developing agent application means.

The words "rigid member" used in this specification stands for a member having a coefficient of deflection, represented by the following relation, $$\frac{l^3}{3EI_z}$$

wherein l is a distance (cm) between the fixed end and a point of load,

E is a modulus of longitudinal elasticity (kg/cm$^2$), and $I_z$ is a geometrical moment of inertia, of from 0 to 0.01, which substantially does not undergo elastic deformation under the condition where it is brought into forced contact with the surface of the developing agent application means.

In order to considerably decrease the thickness of the layer of the developing agent formed on the surface of the developing agent application means, it is desired to extend the rigid member in a direction opposite to the direction in which the surface of the developing agent application means moves, so that the free end of the rigid member is protruded toward the upstream side as viewed in a direction in which the developing agent application means moves. From the standpoint of the thickness of the developing agent layer and the charging property of the toner constituting the developing agent, it is desired that the rigid member has a length of protrusion of from 0.5 to 4.0 mm, particularly, from 1.0 to 3.5 mm, and more particularly, from 2.0 to 2.5 mm at the free end thereof.

The surface precision of the layer of the developing agent formed on the surface of the developing agent application means is seriously affected by the surface roughness of the region on one surface of the rigid member that is brought into forced contact with the surface of the developing agent application means. In order to form the layer of the developing agent which is uniform in the direction of width, it is desired that the surface roughness Ra (center line average roughness specified under JIS B 0601) of at least the above-mentioned region on one surface of the rigid member is 6.00 or smaller, particularly, 0.20 or smaller, and more particularly, 0.02 or smaller.

A material having a sufficiently small surface roughness and yet available at a low cost can be typified by a sheet glass. When it is desired to apply a bias voltage to the limiting means, there can be used a sheet glass (e.g., a sheet glass placed in the market in the trade name of "Nesa Glass") of which one surface is coated with an electrically conducting film. As desired, the limiting means may be constituted by using a stainless steel plate of which the one surface is suitably treated.

In order to sufficiently decrease the thickness of the developing agent layer formed on the surface of the developing agent application means, it is desired to set the line pressure (pressure per a unit length in the direction of width) of one surface of the rigid member to be from 10 to 80 g/cm, particularly from 20 to 70 g/cm, and more particularly from 40 to 60 g/cm with respect to the surface of the developing agent application means.

The limiting means constituted by the rigid member is particularly effectively used in an apparatus for developing an electrostatic latent image which uses a developing agent consisting of only toner having a volume average grain size of 8.0 to 12.0 μm. In this case, it is desired to constitute the developing agent application means using a solid synthetic rubber roller having an Asker's C hardness of from 45 to 65. In the developing zone, it is desired that the solid synthetic rubber roller is brought into forced contact with the surface of the electrostatic latent image carrier on which is formed an electrostatic latent image that is to be developed, such that the solid synthetic rubber roller is elastically compressed by about 0.05 to about 0.15 mm. The electrostatic latent image carrier may be a rotary drum which has on the peripheral surface thereof a suitable electrostatic photosensitive material such as an organic photosemiconductor. In the developing zone, it is desired to move the surface of the electrostatic latent image carrier in the same direction as the direction in which the surface of the solid rubber roller moves, in order to establish a relationship $1.5V1 \leqq V2 \leqq 2.2V1$ between a moving speed V1 of the surface of the electrostatic latent image carrier and a moving speed V2 of the surface of the solid rubber roller. In the developing agent-holding region, it is desired to dispose a foamed auxiliary roller that comes into forced contact with the surface of the solid synthetic rubber roller, so that the auxiliary roller is elastically compressed by 0.15 to 0.25 mm, and to move the surface of the solid rubber roller in the direction opposite to the direction in which the surface of the auxiliary roller moves in the developing agent-holding zone, in order to establish a relationship $0.4V2 \leqq V3 \leqq 1.8V2$ between the moving speed V2 of the surface the solid rubber roller and a moving speed V3 of the surface of the foamed roller. When the speed V3 is smaller than the speed 0.4 V2, the toner remaining on the surface of the solid synthetic rubber roller after developing is scraped off in a less amount by the auxiliary roller, with the consequence that a toner image the same as the previous toner image which is a so-called character memory tends to appear again on the developed toner image. Conversely, when the speed V3 becomes greater than the speed 1.8 V2, the toner is excessively acted upon by the surface of the solid synthetic rubber roller, whereby the toner is electrically charged excessively, the density of the developed toner image becomes too small and besides, the toner tends to be scattered around due to the auxiliary roller that is revolving.

In the apparatus for developing an electrostatic latent image of the present invention, the one surface of the rigid member constituting the limiting means is brought into forced contact with the surface of the developing agent application means, whereby the amount of the developing agent held on the surface of the developing agent application means is suitably limited and a layer of the developing agent is formed as desired on the surface of the developing agent application means. As will become obvious from the examples appearing later, the thickness of the developing agent layer formed on the surface of the developing agent application means is set to assume a required value very precisely and becomes sufficiently uniform in the direction of width.

DETAILED DESCRIPTION OF THE PREFERRED EMBODIMENT

A preferred embodiment of the apparatus for developing an electrostatic latent image constituted according to the present invention will be described in further detail with reference to the accompanying drawings.

Figure 1:
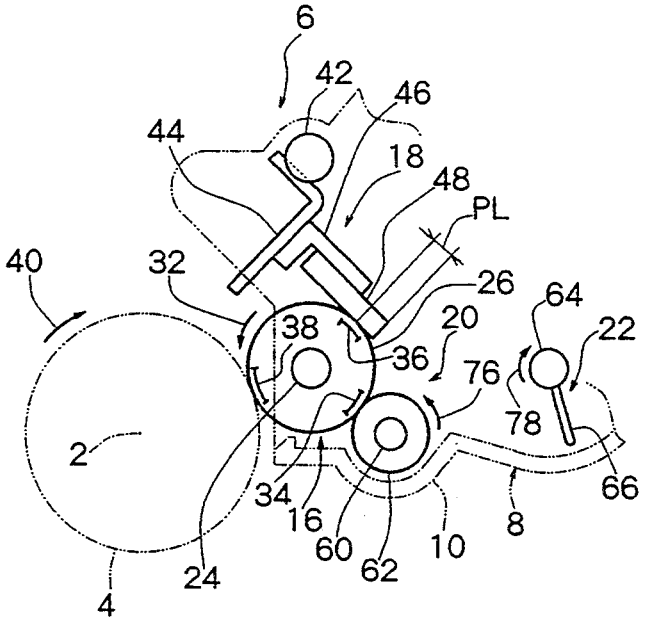
FIG. 1 is a sectional view which schematically illustrates major portions of an apparatus for developing an electrostatic latent image constituted according to a preferred embodiment of the present invention.
Figure 2:
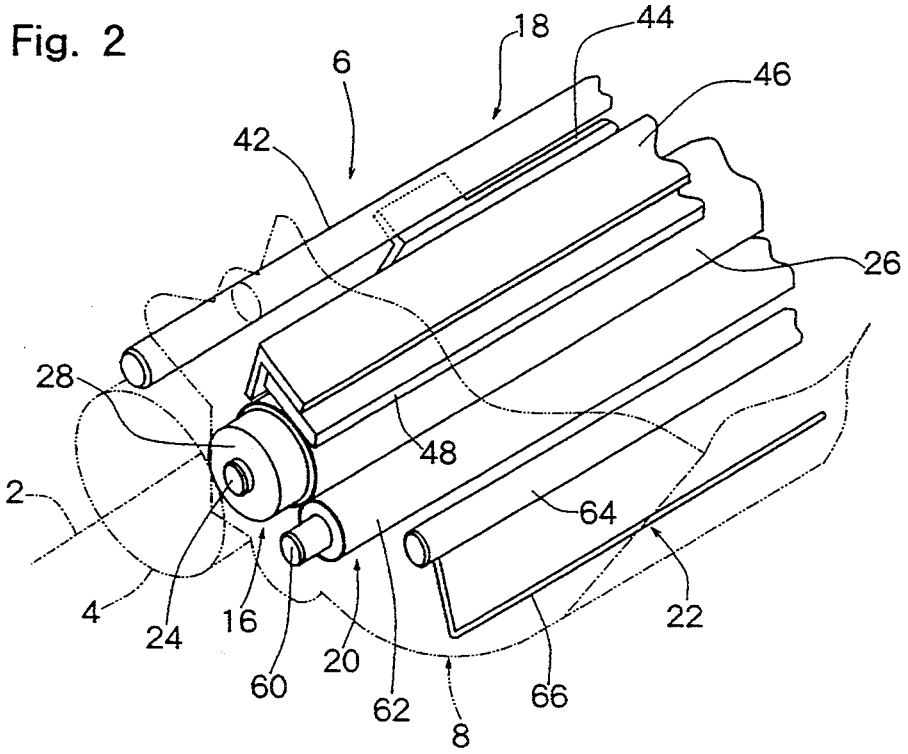
FIG. 2 is a perspective partial view which schematically illustrates major portions of the apparatus for developing an electrostatic latent image of FIG. 1.

With reference to FIGS. 1 and 2, the illustrated embodiment has a drum 4 which is mounted to rotate on a center axis 2 that extends substantially horizontally (perpendicularly to the surface of the paper in FIG. 1). The drum 2 has on the peripheral surface thereof an electrostatic photosensitive material such as an organic photosemiconductor, and an electrostatic latent image is formed on the electrostatic photosensitive material by a suitable method such as the so-called Carlson's process. An apparatus for developing an electrostatic latent image which is generally designated at 6 is provided to develop an electrostatic latent image into a toner image.

Figure 3:
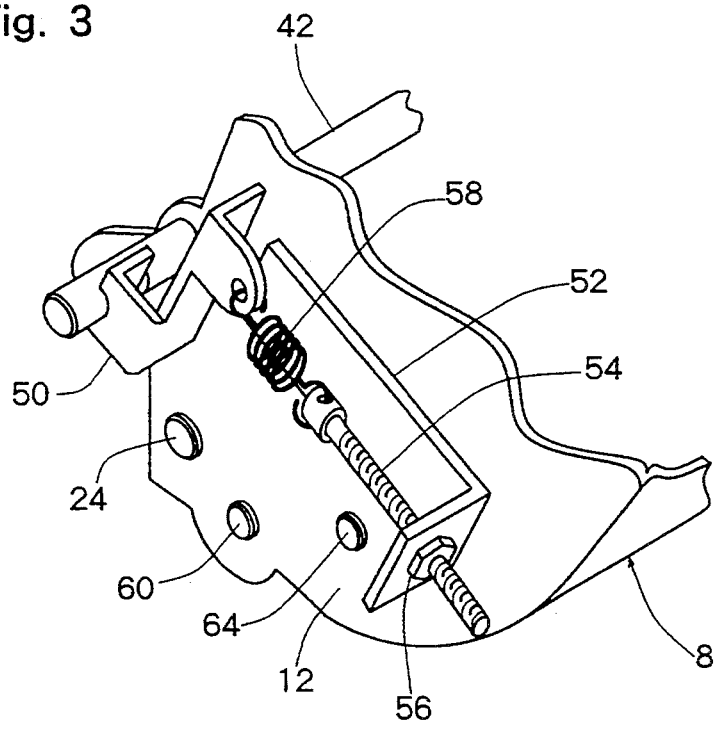
FIG. 3 is a perspective partial view illustrating the front surface portion of a developing housing in the apparatus for developing an electrostatic latent image of FIG.1.

The developing apparatus 6 is equipped with a developing housing 8 which has a bottom wall 10, a front side wall 12 and a rear side wall 14 (refer also to FIGS. 3 and 4) that stand upright from both ends of the bottom wall 10. Between the two side walls 12 and 14 of the developing housing 8 are arranged a developing agent application means 16, a limiting means 18, a feeding means 20 and an agitator means 22. Moreover, though not illustrated, a toner cartridge holding the toner is disposed over the agitator means 22.

The developing agent application means 16 includes a rotary shaft 24 rotatably mounted between the two side walls 12 and 14 of the developing housing 8, a roller 26 fixed to the rotary shaft 24, and collar members 28 rotatably mounted on the rotary shaft 24 on both sides of the roller 26. The rotary shaft 24 can be made of a suitable metallic material such as a stainless steel. It is desired that the roller 26 is made of a material which is relatively soft and is electrically conductive. A preferred material for forming the roller 26 can be typified by an electrically conducting solid rubber such as an urethane rubber. The roller 26 should have an Asker's C hardness of from about 45 to about 65, and should, further, have a volume resistivity of from about $10^6$ to about $10^9$ Ω.cm. The collar members 28 can be made of a suitable synthetic resin having an outer diameter which is slightly smaller than the outer diameter of the roller 26. The roller 26 and the collar members 28 of the developing agent application means 16 are exposed through an opening formed in the developing housing 8 and face a drum 4. The peripheral surfaces of the collar members 28 are brought into contact with the peripheral surface of the drum 4, so that the roller 26 is positioned at a required position with respect to the drum 4. Since the outer diameter of the roller 26 is slightly greater than the outer diameter of the collar members 28, the peripheral surface of the roller 26 is brought into forced contact with the peripheral surface of the drum 4, and the peripheral surface of the roller 26 is slightly compressed resiliently in the forcibly contacting region. Usually, it is desired that the amount of compression of the roller 26 is from about 0.05 to about 0.15 mm though it may vary depending upon the outer diameter size of the roller 26.

Figure 4:
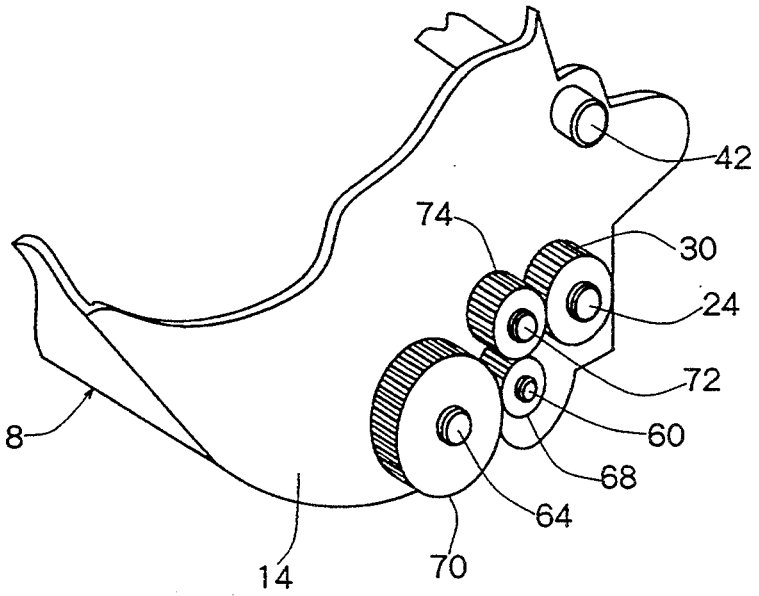
FIG. 4 is a perspective partial view illustrating the rear surface portion of the developing housing in the apparatus for developing an electrostatic latent image of FIG. 1.

As shown in FIG. 4, the rear end of the rotary shaft 24 of the developing agent application means 16 rearwardly protrudes beyond the rear side wall 14 of the developing housing 8, and an input gear 30 is fitted to the rear end which protrudes. The input gear 30 is coupled to an electric motor (not shown) via a suitable transmission means (not shown), and the rotary shaft 24 is continuously rotated in a direction indicated by arrow 32 in FIG. 1. With reference to FIG. 1, the roller 26 is continuously rotated in the direction indicated by arrow 32 with the rotation of the rotary shaft 24, and the peripheral surface of the roller 26 is conveyed passing through a developing agent-holding zone 34, a developing agent-limiting zone 36 and a developing zone 38, successively. In the developing agent-holding zone 34 as will be described later in further detail, the feeding means 20 acts on the roller 26, whereby the used developing agent held on the peripheral surface of the roller 26 is peeled off the roller 26 and the fresh developing agent is newly fed onto the peripheral surface of the roller 26. In the developing agent-limiting zone 36, the limiting means 18 acts on the developing agent held on the peripheral surface of the roller 26, whereby the developing agent held on the peripheral surface of the roller 26 is limited to a required amount to form a thin layer. Upon receiving the action of the limiting means 18, furthermore, the toner constituting the developing agent is frictionally charged into a predetermined polarity, e.g., into a positive polarity. In the developing zone 38, the developing agent is applied onto the electrostatic latent image on the electrostatic photosensitive material disposed on the peripheral surface of the drum 4 so that the electrostatic latent image is developed into a toner image. For instance, the electrostatic latent image has a non-image region which is charged to about +700 V and an image region which is charged to about +120 V, and the toner adheres onto the image region (so-called reversal developing). The drum 4 is continuously rotated in a direction indicated by arrow 40 in FIG. 1. In the developing zone 38, therefore, the peripheral surface of the drum 4 and the peripheral surface of the roller 26 of the developing agent application means 16 move in the same direction. A moving speed V2 of the peripheral surface of the roller 26 is set to be slightly greater than a moving speed V1 of the peripheral surface of the drum 4, preferably in a relationship of 1.5 $V1 \leqq V2 \leqq 2.2\ V1$. In this case, the developing agent is sufficiently carried by the roller 26 to the developing zone 38, the toner that has once adhered to the non-image portion of the electrostatic latent image is properly peeled off by the scraping action of the peripheral surface of the roller 26 on the peripheral surface of the drum 4 and, thus, there can be obtained a good toner image having a properly developed density without fogging. Desirably, the developing agent consists of toner only having a volume average grain size (vol. 50%: the volume of the toner smaller than the volume average grain size is the same as the volume of the toner larger than the volume average grain size) of from 8.0 to 12.0 μm and a volume resistivity of eighth power of ten or greater.

With further reference to FIGS. 1 and 2, the limiting means 18 includes a rotary shaft 42 which is rotatably mounted between the two side walls 12 and 14 of the developing housing 8. A support member 46 is fitted via a connection bracket 44 to the rotary shaft 42 that can be constituted by a stainless steel rod. The connection bracket 44 and the support member 46 can be made of a suitable metal plate such as a stainless steel or aluminum plate. The support member 46 has an L-shape in cross section, and a rigid member 48 is fastened to the inside surface of the support member by a suitable method such as screws. As clearly diagramed in FIG. 3, the front end of the rotary shaft 42 protrudes forward beyond the front side wall 12 of the developing housing 8, and a coupling member 50 is fitted to the protruded front end thereof. On the other hand, an L-shaped bracket 52 is fastened to the front surface of the front side wall 12 of the developing housing 8, and a threaded hole is formed in the support portion of the bracket 52. A threaded rod 54 is screwed into the threaded hole of the bracket 52, and a lock nut 56 is screwed to the threaded rod 54. A tension spring 58 is extended between an end portion of the threaded rod 54 and a free end of the coupling member 50. The tension spring 58 resiliently urges the rotary shaft 42 in the clockwise direction in FIG. 1, whereby one surface, i.e., inside surface of the rigid member 48 is brought into forced contact with the peripheral surface of the roller 26 of the developing agent application means 16. The contacting force of the rigid member 48 with respect to the peripheral surface of the roller 26 can be suitably adjusted by changing the position at which the threaded rod 54 is fixed to the bracket 52.

It is desired that the rigid member 48 is constituted by a plate-like member of which at least the one surface (i.e., surface forcibly contacted to the peripheral surface of the roller 26) extends in the direction of width (direction perpendicular to the surface of the paper in FIG. 1) along the peripheral surface of the roller 26. As will be understood from the description appearing later, it is desired that the region on one surface of the rigid member 48 that is at least brought into forced contact with the peripheral surface of the roller 26 has a sufficiently small surface roughness i.e., the center line average roughness, Ra, stipulated under JIS B 0601, is 6.00 or smaller, particularly, 0.20 or smaller, and more particularly, 0.02 or smaller. When the surface roughness on one surface of the rigid member 48 becomes excessive, the surface of the thin developing agent layer on the peripheral surface of the roller 26 of the developing agent application means 16 is not sufficiently flattened and tends to become nonuniform. A sheet glass placed in the market can be favorably used as a rigid material for forming the rigid member 48 because it is available at a relatively low cost yet maintaining the surface roughness very small. An electrically conducting film may be applied onto one surface of the sheet glass when it is desired to apply a required voltage to the rigid member 48 to control the electric charging property of the toner. As the sheet glass having an electrically conducting film applied onto one surface thereof, there can be favorably used a sheet glass that has been placed in the market in the trade name of "Nesa Glass". The rigid member 48 can be constituted by using a suitable metal plate such as a stainless steel instead of using the sheet glass. As required, the one surface of the metal plate constituting the rigid member 48 may be suitably treated in order to sufficiently decrease the surface roughness on one surface of the metal plate. If desired, the rigid member 48 may be constituted by using a laminate of a sheet glass and a metal plate, and the one surface that comes into forced contact with the roller 26 of the developing agent application means 16 may be defined by the exposed surface of the sheet glass.

The contacting force of the rigid member 48 with respect to the peripheral surface of the roller 26 of the developing agent application means 16 can be suitably set depending upon the thickness of the developing agent layer that is formed on the peripheral surface of the roller 26. The thickness of the developing agent layer decreases with an increase in the contacting force. As the contacting force becomes too great, on the other hand, the roller 26 tends to be prevented from smoothly rotating. In the developing mode of the illustrated embodiment, the developing agent layer formed on the peripheral surface of the roller 26 usually have a thickness of 15 to 40 μm and, particularly preferably , about 20 μm. In order to form the developing agent layer having such a thickness, the rigid member 48 is preferably brought into forced contact with the peripheral surface of the roller 26 at a line pressure (pressure per a unit length in the direction of width) of from 10 to 80 g/cm, more preferably from 20 to 70 g/cm, and particularly preferably from 40 to 60 g/cm.

It is desired that the free end of the rigid member 48 is slightly protruded toward the upstream side beyond a portion where the rigid member 48 is brought into forced contact with the roller 26 as viewed in a direction in which the roller 26 moves. The length of protrusion of the free end of the rigid member 48 (i.e., the length from the contacting center of the roller 26 and the rigid member 48 to the free end of the rigid member 48) PL should, generally, be from 0.5 to 4.0 mm, preferably from 0.8 to 3.5 mm, and more preferably from 1.0 to 2.0 mm. As will be referred to later, when the length of protrusion PL becomes too short or substantially zero, the limiting action of the rigid member 48 becomes excessive and it becomes difficult to obtain a suitable developing agent layer. When the length of protrusion becomes too long, the thickness of the formed developing agent layer tends to become too great and the amount of charge of the toner tends to become too small.

With reference to FIGS. 1 and 2, the feeding means 20 includes a rotary shaft 60 that is rotatably mounted between the two side walls 12 and 14 of the developing housing 8, and an auxiliary roller 62 fitted to the rotary shaft 60. It is desired that the auxiliary roller 62 is constituted by a foamed material such as foamed silicone or foamed urethane. The auxiliary roller 62 is brought into forced contact with the roller 26 of the developing agent application means 16. It is desired that the foamed material forming the auxiliary roller 62 has a hardness (e.g., Asker's C hardness of about 35) which is considerably smaller than the hardness of the roller 26, and that when the auxiliary roller 62 is brought into contact with the roller 26, the auxiliary roller 62 is elastically compressed by about 0.15 to 0.25 mm in the region of forced contact. The agitator means 22 includes a rotary shaft 64 rotatably mounted between the two side walls 12 and 14 of the developing housing 8 and an agitator member 66 fitted to the rotary shaft 64. The agitator member 66 has radially protruded portions that protrude in the radial direction from both ends of the rotary shaft 64 and a main portion that extends between the radially protruded portions in parallel with the rotary shaft 64. As clearly shown in FIG. 4, both the rear end of the rotary shaft 60 of the feeding means 20 and the rear end of the rotary shaft 64 of the agitator means 22 rearwardly protrude beyond the rear side wall 14 of the developing housing 8, and input gears 68 and 70 are fitted to these protruded rear ends, respectively. The input gear 68 and the input gear 70 are in mesh with each other. A rearwardly extending short shaft 72 is fitted to the rear side wall 14 of the developing housing 8, and a transmission gear 74 is fitted to the short shaft 72. The input gear 68 is engaged with the transmission gear 74 which is engaged with the input gear 30 fitted to the rotary shaft 24 of the developing agent application means 16. When the rotary shaft 24 and roller 26 of the developing agent application means 16 are rotated in a direction of arrow 32 in FIG. 1, the rotary shaft 60 and auxiliary roller 62 of the feeding means 20 are rotated in a direction indicated by arrow 76 in FIG. 1, and the rotary shaft 64 and agitator member 66 of the agitator means 22 are rotated in a direction indicated by arrow 78 in FIG. 1. The agitator member 66 of the agitator means 22 rotating in the direction of arrow 78 works to agitate the toner or developing agent that flows down from a toner cartridge (not shown) disposed at an upper position as well as the developing agent peeled off the roller 26 of the developing agent application means 16 due to the action of the feeding means 20. The auxiliary roller 62 of the feeding means 20 rotating in the direction of arrow 76 holds the developing agent agitated by the agitator means 66 on the peripheral surface thereof, and feeds the developing agent onto the peripheral surface of the roller 26 on the downstream side, as viewed in a direction in which the roller 26 rotates, of the portion where the auxiliary roller 62 is forcibly contacting to the roller 26 of the developing agent application means 16. Then, after the developing operation through the developing zone 38, the auxiliary roller 62 scrapes off the developing agent remaining on the peripheral surface of the roller 26 on the upstream side, as viewed in a direction in which the roller 26 rotates, of the portion where the auxiliary roller 62 is forcibly contacted to them roller 26. As indicated by arrows 32 and 76 in FIG. 1, the roller 26 and the auxiliary roller 62 rotate in the opposite directions relative to each other at the portion where they are forcibly contacted to each other. From the results of extensive experiments conducted by the present inventors, it is desired that a relationship $0.75\ V2 \leqq V3 \leqq 0.85\ V2$ is established between a moving speed V2 of the peripheral surface of the roller 26 and a moving speed V3 of the peripheral surface of the auxiliary roller 62.

Described below are various examples comparative example of the present invention.

[EXAMPLE 1]

A developing apparatus constituted as shown in FIGS. 1 to 4 was prepared and operated. The roller of the developing agent application means in the developing apparatus was made of a solid urethane rubber, and possessed an Asker's C hardness of 55, an outer diameter of 20.00 mm and a length of 234.00 mm in the direction of the axial thereof. The collar members of the developing agent application means were made of a polyacetal resin, and possessed an outer diameter of 19.90 mm. By bringing the peripheral surfaces of the collar members into contact with the peripheral surface of the drum, therefore, the roller was elastically compressed by 0.10 mm in the developing zone. The auxiliary roller of the feeding means was made of foamed silicone (closed-cellular type), and possessed an Asker's C hardness of 35, an outer diameter of 12.00 mm and a length of 215.50 mm in the direction of axis thereof. The number of revolutions of the roller of the developing agent application means was 80.1 rpm, the number of revolutions of the auxiliary roller of the feeding means was 110.5 rpm and, hence, a relationship 0.828 V2=V3 was established between a moving speed V2 of the peripheral surface of the roller of the developing agent application means and a moving speed V3 of the peripheral surface of the auxiliary roller of the feeding means.

The rigid member of the limiting means was made of a soda quartz glass (Nesa Glass) having a thin electrically conductive tin oxide thin film applied onto the surface thereof that comes into forced contact with the roller of the developing agent application means, and possessed a thickness of 1.2 mm and a length of 214.5 mm in the lengthwise direction. The line pressure of the rigid member against the peripheral surface of the roller of the developing agent application means was 46.38 g/cm. The length PL of protrusion PL (FIG. 1) of the free end of the rigid member was 3.0 mm. The surface roughness Ra on the surface of the rigid member forcibly contacted to the roller was 0.01 as measured by using a surface roughness-measuring instrument that is placed in the market by Tokyo Seimitsu Co. in the trade name of "Handysurf E-30A". The coefficient of deflection of the rigid member was $1.18\times10^{-6}$.

The developing agent used was a one-component type developing agent consisting of only toner having a volume average grain size (vol. 50%) of 10.52 μm and a bulk density, as stipulated under JIS K5010, of 0.303 g/cm$^2$. An organic photosemiconductor (organic photosemiconductor of a model disclosed in Japanese Laid-Open Patent Publication No. 295853/1992) was disposed on the peripheral surface of the drum on which will be formed an electrostatic latent image that is to be developed by the developing apparatus, and the drum possessed the outer diameter of 40.00 mm. The number of revolutions of the drum was 22.9 rpm and, hence, a relationship was 1.747 V1=V2 between a moving speed V1 of the peripheral surface of the drum and a moving speed V2 of the peripheral surface of the roller of the developing agent application means. A bias voltage of +350 V was applied to the rotary shaft made of a stainless steel of the developing agent application means, a bias voltage of +50 V was applied to the rotary shaft made of a stainless steel of the feeding means, and a bias voltage of +350 V was applied to the thin electrically conducting tin oxide film applied onto one surface of the rigid member of the limiting means.

In an environment of a temperature of 20° C. and a humidity of 65%, the roller of the developing agent application means, the auxiliary roller of the feeding means and the agitator means were stopped after every rotation for 6 seconds, in order to measure the thickness of the developing agent layer held on the peripheral surface of the roller of the developing agent application means, amount of electric charge and amount of the filled developing agent between the developing agent-limiting zone and the developing zone. The thickness of the developing agent layer was measured by an ordinary microscopic measuring method (in which thickness of the developing agent layer was measured based upon a difference between when the microscope was focused on the peripheral surface of the roller and when the microscope was focused on the peripheral surface of the developing agent layer). The amount of the electric charge of the developing agent was calculated in terms of the amount of electric charge per gram of toner (μc/g) by sucking the toner from the peripheral surface of the roller with an ordinary noncontact-type instrument for measuring the amount of electric charge of the toner (of a model shown in FIG. 8 of Japanese Patent Application No. 261482/1992), and dividing the value measured using a potentiometer by the weight of the toner. The amount of the filled developing agent was calculated in terms of the weight of the toner per square centimeter (g/cm$^2$) on the peripheral surface of the roller by dividing the amount of the toner sucked using the above measuring instrument by the area of suction on the peripheral surface of the roller. As for the thickness of the developing agent layer, the thickness of the developing agent layer was measured at four places at a spaced distance in the lengthwise direction of the roller of the developing agent application means, and the measurement was taken two times (the roller of the developing agent application means, the auxiliary roller of the feeding means and the agitator means were rotated for 6 seconds and were stopped to take the measurement of the first time and then, the roller of the developing agent application means, the auxiliary roller of the feeding means and the agitator means were rotated again for 6 seconds and were stopped to take the measurement of the second time) in order to calculate an average value of measurement and a maximum difference among the measured values. The amount of electric charge and the amount of the filled developing agent were measured by sucking the toner at a central portion in the lengthwise direction of the roller of the developing agent application means and repeating such measurement eight times (measurement was repeated eight times by rotating the roller of the developing agent application means, the auxiliary roller of the feeding means and the agitator means for 6 seconds each time and stopping them), in order to calculate an average value of measurement and a maximum difference among the measured values. The calculated average value of layer thickness, maximum difference thereof, average value of the amount of electric charge, maximum difference thereof, average value of the amount of the filled developing agent and maximum difference thereof are as shown in Table 1.

Then the organic photosemiconductor material disposed on the peripheral surface of the drum was electrically charged uniformly and was then selectively irradiated with a laser beam in order to form an electrostatic latent image having a non-image region of +700 V and an image region of +120 V on the organic photosemiconductor. The electrostatic latent image included a plural number of image regions (so-called solid-black regions) each having a size of 30×30 mm. The electrostatic latent image was developed into a toner image (reversal developing) by using the above developing apparatus, and the toner image was transferred onto a common paper. In transferring the toner image, the surface of the common paper was brought into intimate contact with the peripheral surface of the drum and a discharge voltage of −5500 V was applied to a corona discharger disposed on the back surface side of the common paper. The toner image transferred onto the common paper was fixed using an ordinary fixing device that includes a heated roller and a pushing roller, and, then, the density ID of the image region and the density FD of the non-image region were measured by using a reflection densitometer placed in the market by Tokyo Denshoku Co. in the trade name of "TC-6DS". The results are as shown in Table 1 below.

[EXAMPLE 2]

Figure 5:
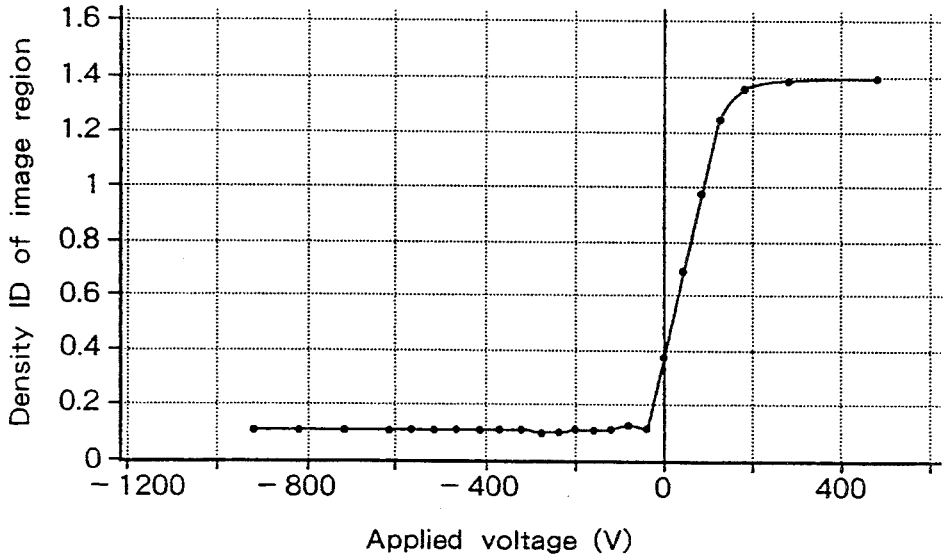
FIG. 5 is a diagram illustrating a relationship between the developing bias voltage and the density of the image region in an example 2 using the apparatus for developing an electrostatic latent image constituted according to the present invention.
Figure 6:
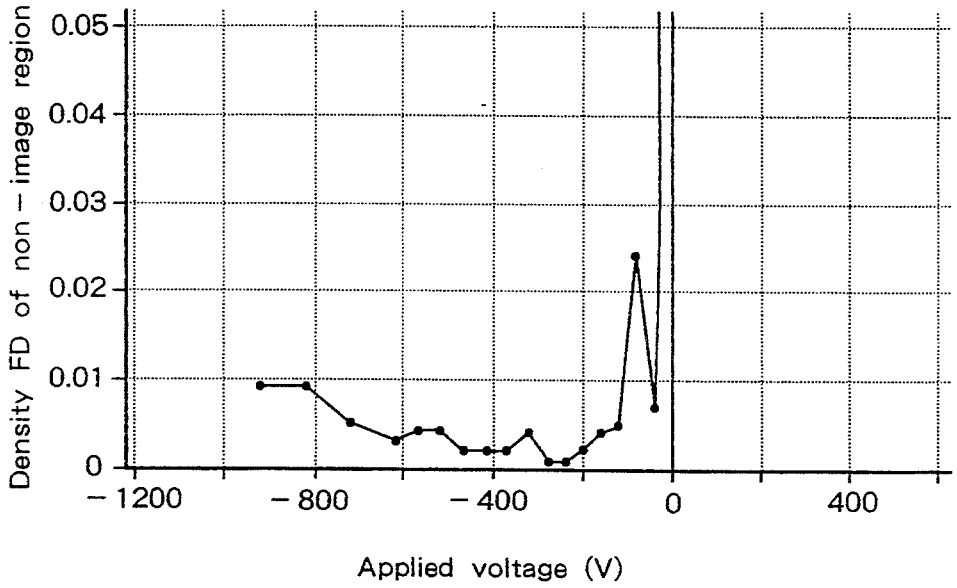
FIG. 6 is a diagram illustrating a relationship between the developing bias voltage applied to the developing agent application means and the density of the non-image region in example 2 using the apparatus for developing an electrostatic latent image constituted according to the present invention.

The toner image was transferred onto a common paper and then fixed under the same conditions as in the above-mentioned Example 1 with the exception of changing the bias voltage applied to the rotary shaft of the developing agent application means. Then, the density ID of the image region and the density FD of the non-image region were measured. The results are as shown in FIGS. 5 and 6.

EXAMPLE 3]

Figure 7:
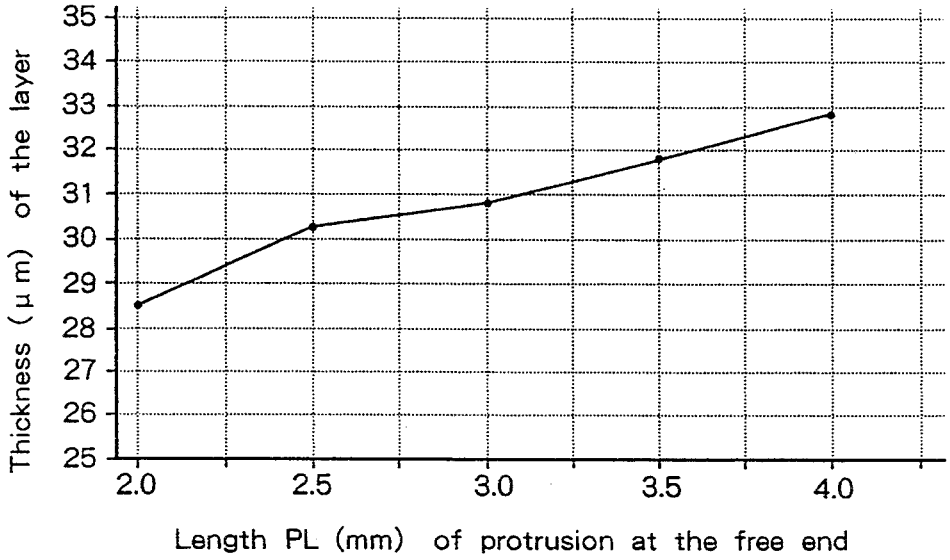
FIG. 7 is a diagram illustrating a relationship between the length of protrusion at the free end of the rigid member in the limiting means and the thickness of the developing agent layer held on the peripheral surface of the roller in the developing agent application means in an example 3 using the apparatus for developing an electrostatic latent image constituted according to the present invention.
Figure 8:
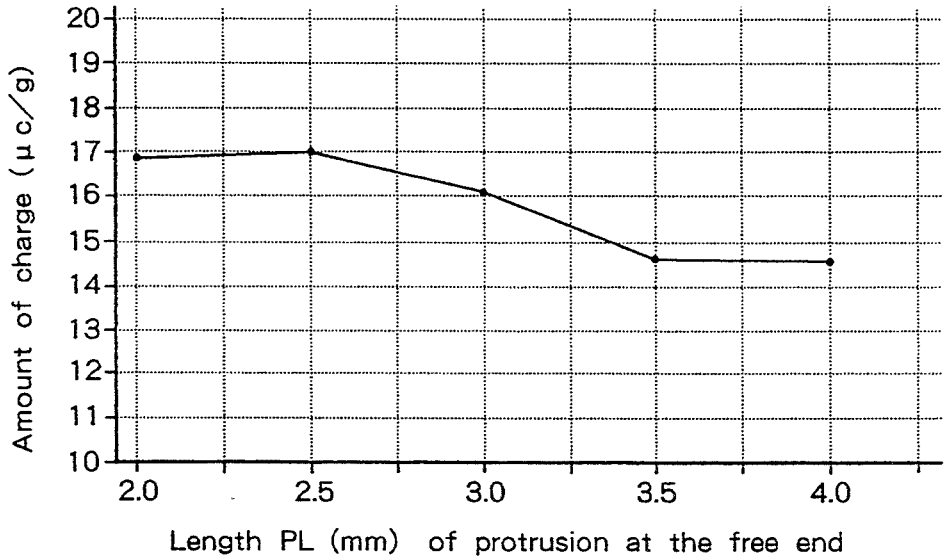
FIG. 8 is a diagram illustrating a relationship between the length of protrusion at the free end of the rigid member in the limiting means and the amount of charge of the developing agent held on the peripheral surface of the roller in the developing agent application means in example 3 using the apparatus for developing an electrostatic latent image constituted according to the present invention.

By using the same developing apparatus as that of the above-mentioned Example 1, the layer thickness and the amount of electric charge of the developing agent held on the peripheral surface of the roller of the developing agent application means were measured under the same conditions as those of the above-mentioned Example 1 with the exception of changing the length of protrusion PL of the free end of the rigid member of the developing agent application means in the environment of a temperature of 20° C. and a humidity of 50%. The results are as shown in FIGS. 7 and 8.

[EXAMPLE 4]

Figure 9:
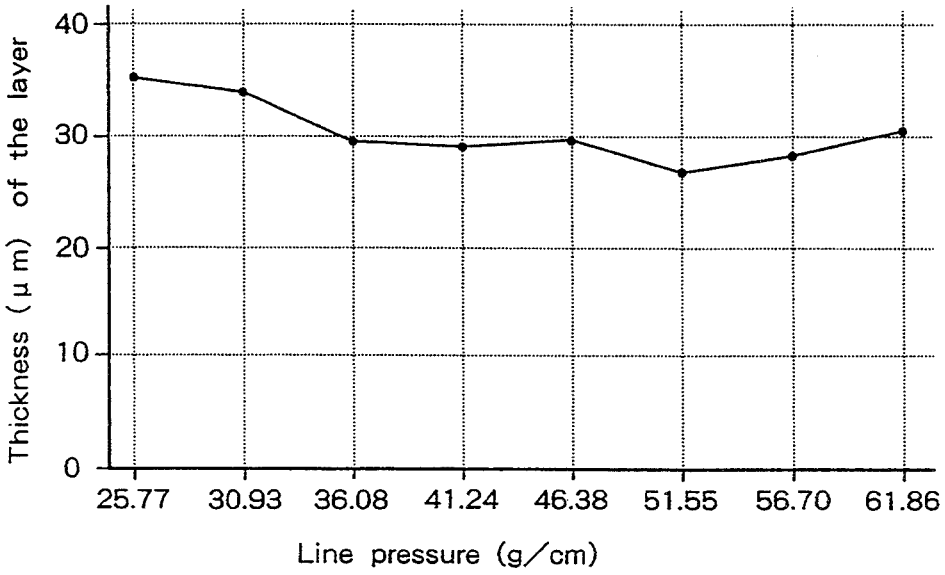
FIG. 9 is a diagram illustrating a relationship between the line pressure of the rigid member in the limiting means against the peripheral surface of the roller of the developing agent application means and the thickness of the developing agent layer held on the peripheral surface of the roller of the developing agent application means in an example 4 using the apparatus for developing an electrostatic latent image constituted according to the present invention.
Figure 10:
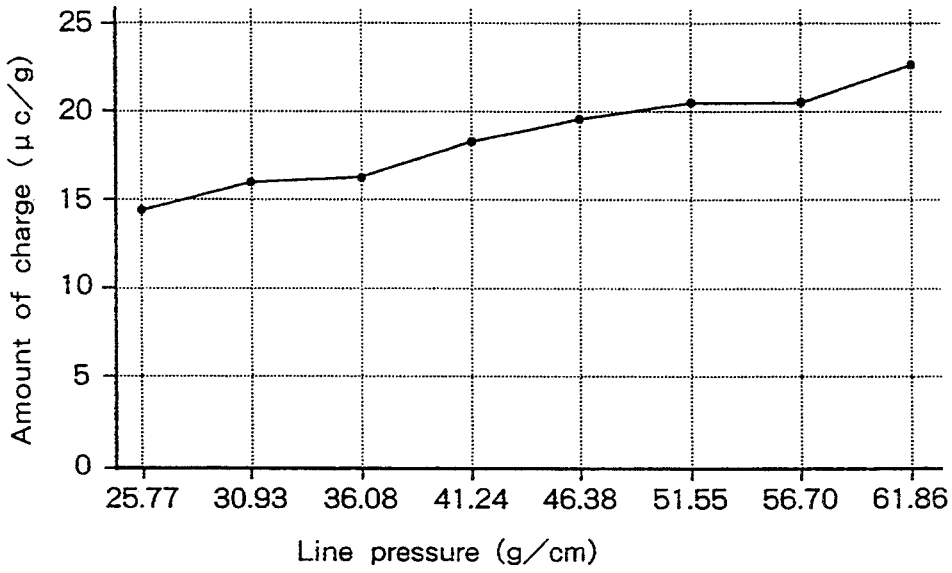
FIG. 10 is a diagram illustrating a relationship between the line pressure of the rigid member in the limiting means against the peripheral surface of the roller of the developing agent application means and the amount of charge of the developing agent held on the peripheral surface of the roller of the developing agent application means in example 4 using the apparatus for developing an electrostatic latent image constituted according to the present invention.

By using the same developing apparatus as that of the above-mentioned Example 1, the layer thickness and the amount of electric charge of the developing agent held on the peripheral surface of the roller of the developing agent application means were measured under the same conditions as those of the above-mentioned Example 1 with the exception of changing the line pressure of the rigid member with respect to the peripheral surface of the roller of the developing agent application means in the environment of a temperature of 20° C. and a humidity of 50%. The results are as shown in FIGS. 9 and 10.

[EXAMPLE 5]

By using the same developing apparatus as that of the above-mentioned Example 1, the layer thickness, the amount of electric charge and the amount of the filled developing agent held on the peripheral surface of the roller of the developing agent application means were measured under the same conditions as those of the above-mentioned Example 1 with the exception of using, as a rigid member, a soda quartz glass having no electrically conducting film on one surface thereof and without applying a bias voltage to the rigid member of the developing agent application means. Further, the toner image was transferred onto a common paper and fixed, and then, the density ID of the image region and the density FD of the non-image density on the common paper were measured. The surface of the rigid member forcibly contacted to the peripheral surface of the roller exhibited a roughness Ra of 0.01, and the coefficient of deflection of the rigid member was $1.18\times10^{-6}$. The measurement results were as shown in Table 1 below.

[EXAMPLE 6]

By using the same developing apparatus as that of the above-mentioned Example 1, the layer thickness, the amount of electric charge and the amount of the filled developing agent held on the peripheral surface of the roller of the developing agent application means were measured under the same conditions as those of the above-mentioned Example 1 with the exception of using, as a rigid member, a stainless steel plate having a thickness of 3.0 mm of which the surface has been specially treated to exhibit a considerably small roughness and which has been placed in the market in the trade name of "Stavax". Further, the toner image was transferred onto a common paper and fixed, and then, the density ID of the image region and the density FD of the non-image density on the common paper were measured. The surface of the rigid member placed forcibly into contact with the peripheral surface of the roller exhibited a coarseness Ra of 0.06, and the coefficient of deflection of the rigid member was $2.63\times10^{-8}$. The measurement results were as shown in Table 1 below.

[EXAMPLE 7]

Figure 11:
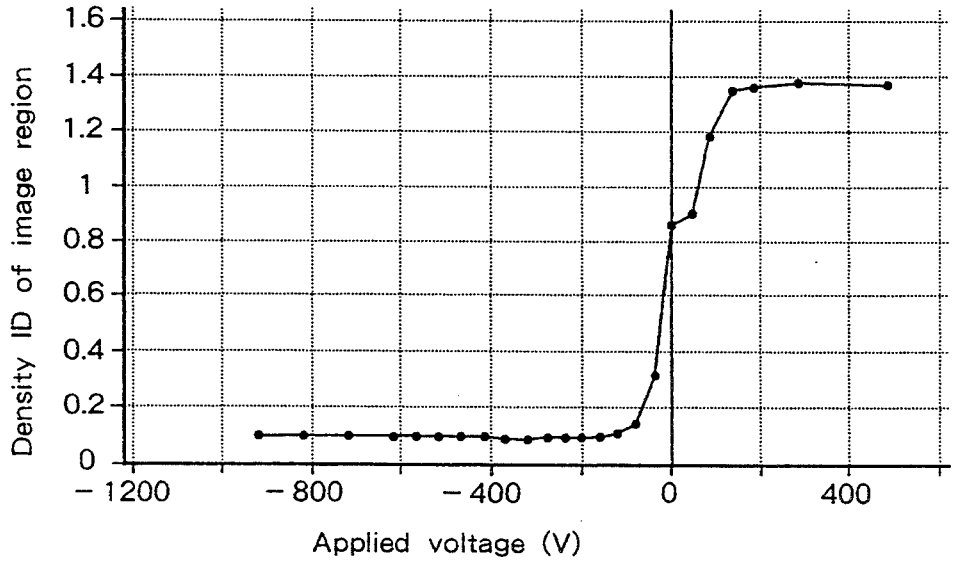
FIG. 11 is a diagram illustrating a relationship between the developing bias voltage and the density of the image region in an example 7 using the apparatus for developing an electrostatic latent image constituted according to the present invention.
Figure 12:
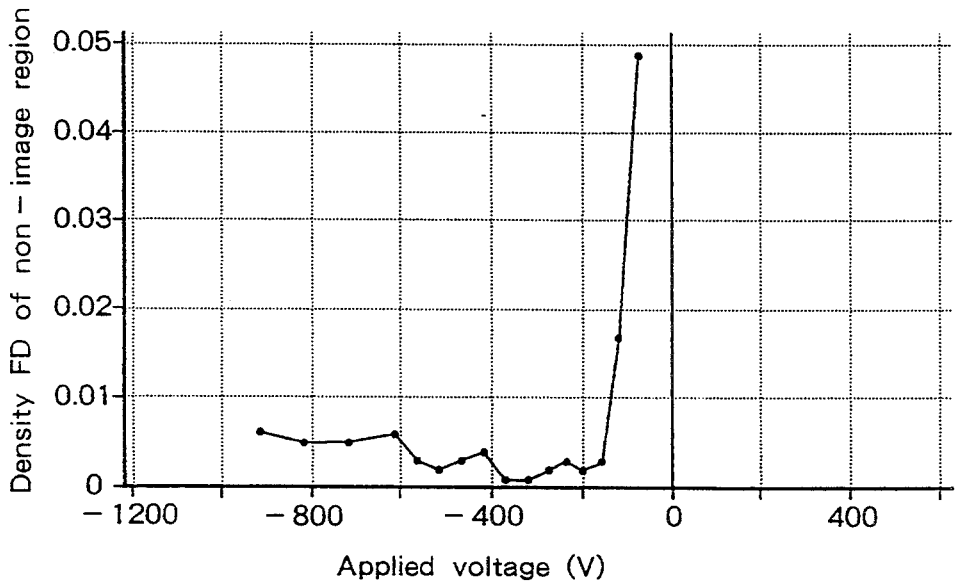
FIG. 12 is a diagram illustrating a relationship between the developing bias voltage and the density of the non-image region in example 7 using the apparatus for developing an electrostatic latent image constituted according to the present invention.

By using the same developing apparatus as that of the above-mentioned Example 2, the toner image was transferred onto a common paper under the same conditions as those of the above-mentioned Example 2 with the exception of using, as a rigid member, a stainless steel plate having a thickness of 3.0 mm of which the surface has been specially treated to exhibit a considerably small roughness and which has been placed in the market in the trade name of "Stavax". Then, the density ID of the image region and the density FD of the non-image region on the common paper were measured. The results were as shown in FIGS. 11 and 12.

[EXAMPLE 8 ]

By using the same developing apparatus as that of the above-mentioned Example 1, the layer thickness, the amount of electric charge and the amount of the filled developing agent held on the peripheral surface of the roller of the developing agent application means were measured under the same conditions as those of the above-mentioned Example 1 with the exception of using an ordinary stainless steel plate as a rigid member. Further, the toner image was transferred onto a common paper and fixed, and then, the density ID of the image region and the density FD of the non-image density on the common paper were measured. The surface of the rigid member placed forcibly into contact with the peripheral surface of the roller exhibited a roughness Ra of 0.18, and the coefficient of deflection of the rigid member was $4.38\times10^{-7}$. The measurement results were as shown in Table 1 below.

[EXAMPLE 9]

By using the same developing apparatus as that of the above-mentioned Example 1, the layer thickness, the amount of electric charge and the amount of the filled developing agent held on the peripheral surface of the roller of the developing agent application means were measured under the same conditions as those of the above-mentioned Example 1 with the exception of using, as a rigid member, a stainless steel plate having a relatively large surface roughness. Further, the toner image was transferred onto a common paper and fixed, and then, the density ID of the image region and the density FD of the non-image density on the common paper were measured. The surface of the rigid member placed forcibly into contact with the peripheral surface of the roller exhibited a roughness Ra of 3.32, and the coefficient of deflection of the rigid member was $4.38 \times 10^{-7}$. The measurement results were as shown in Table 1 below. [Comparative Example ]

By using the same developing apparatus as that of the above-mentioned Example 1, the layer thickness, the amount of electric charge and the amount of the filled developing agent held on the peripheral surface of the roller of the developing agent application means were measured under the same conditions as those of the above-mentioned Example 1 with the exception of using, as the limiting means, a stainless steel plate having a coefficient of deflection of $3.00 \times 10^{-2}$, i.e. a non-rigid member and having a thickness of 0.1 mm. Further, the toner image was transferred onto a common paper and fixed, and the density ID of the image region and the density FD of the non-image density were measured. The surface of the rigid member placed forcibly into contact with the peripheral surface of the roller exhibited a roughness Ra of 0.30. The measurement results were as shown in Table 1 below.

TABLE 1

| | Surface roughness (Ra) | Coefficient of deflection | Thickness of layer (μm) | | Amount of electric charge (μc/g) | | Amount of the filled developing agent (mg/cm²) | | Density ID of image region | Density FD of non-image region |
|---|---|---|---|---|---|---|---|---|---|---|
| | | | Average value | Max difference | Average value | Max difference | Average value | Max difference | | |
| Example 1 | 0.01 | $1.18 \times 10^{-6}$ | 29.8 | 7.8 | 16.03 | 3.7 | 9.31 | 0.8 | 1.399 | 0.001 |
| Example 5 | 0.01 | $1.18 \times 10^{-6}$ | 30.4 | 7.9 | 16.01 | 3.2 | 9.20 | 0.7 | 1,396 | 0.001 |
| Example 6 | 0.06 | $2.63 \times 10^{-8}$ | 33.0 | 8.0 | 15.46 | 2.5 | 10.97 | 2.7 | 1.400 | 0.001 |
| Example 8 | 0.18 | $4.38 \times 10^{-7}$ | 32.5 | 9.6 | 13.21 | 4.8 | 12.32 | 2.9 | 1.408 | 0.005 |
| Example 9 | 3.32 | $4.38 \times 10^{-7}$ | 35.4 | 12.2 | 13.40 | 6.2 | 7.13 | 3.6 | 1.402 | 0.008 |
| Comparative Example | 0.30 | $3.00 \times 10^{-2}$ | 31.0 | 15.3 | 14.03 | 8.0 | 11.50 | 5.5 | 1.400 | 0.012 |

It is understood from a consideration of the measurement results shown in Table 1 that when the limiting member is the rigid member, the maximum differences among the measured values in any of the layer thickness of the developing agent, the amount of electric charge thereof and the amount of the filled developing agent are decreased in comparison with the results obtained when the limiting member is a non-rigid member, and that the developing agent layer has a sufficiently uniform thickness in the direction of width on the roller of the developing agent application means. Further, it is recognized from the measurement results that there is no significant difference among the densities ID of the image region, but when the limiting member is made of a non-rigid member, the density FD of the non-image region becomes relatively great. When the density FD of the non-image region exceeds 0.01, generally, so-called fogging that can be perceived with the naked eyes is produced. Further, it is recognized that as the surface roughness of the limiting member is smaller, the uniformity in the axial direction of the roller of the developing agent layer formed on the roller of the developing agent application means is improved and the density FD of the non-image region is also decreased.

[EXAMPLE 10]

Using the same developing apparatus as that of the above-mentioned Example 1, the developing, the transferring and the fixing were carried out continuously ten thousand times under the same conditions as those of the above-mentioned Example 1 (i.e., in the environment of a temperature of 20° C. and a humidity of 65%). Then, the amount of electric charge of the layer of the developing agent held on the peripheral surface of the roller of the developing agent application means and the density ID of the image region and the density FD of the non-image region of the toner image fixed on a common paper were measured in the initial state (prior to the continuous operations) and after ten thousand operations (after the continuous operations). The results are as shown in Table 2 below.

[EXAMPLE 11]

Continuous ten thousand operations of the developing, the transferring and the fixing were carried out under the same conditions as those of the above-mentioned Example 10 with the exception of using, as the rigid member, an ordinary stainless steel plate used in the above-mentioned Example 8. Then, the amount of electric charge of the layer of the developing agent held on the peripheral surface of the roller of the developing agent application means and the density ID of the image region and the density FD of the non-image region of the toner image fixed on a common paper were measured in the initial state (prior to the continuous operations) and after ten thousand operations (after the continuous operations). The results are as shown in Table 2 below.

[EXAMPLE 12]

Using the same developing apparatus as that of the above-mentioned Example 1, the developing, the transferring and the fixing were carried out continuously two thousand times under the same conditions as those of the above-mentioned Example 1 with the excepting that the developing apparatus was allowed to stand in an environment of a low temperature and a low humidity, i.e. at a temperature of 10° C. and a humidity of 45% for 12 hours, and thereafter the operations were carried out in the aforesaid environment. Then, the density ID of the image region and the density FD of the non-image region of the toner image fixed on a common paper were measured in the initial state (prior to the continuous operations) and after two thousand operations (after the continuous operations). The results are as shown in Table 3 below.

[EXAMPLE 13]

Continuous two thousand operations of the developing, the transferring and the fixing were carried out under the same conditions as those of the above-mentioned Example 12 with the exception of using, as the rigid member, an ordinary stainless steel plate used in the above-mentioned Example 8. Then, the density ID of the image region and the density FD of the non-image region of the toner image fixed on a common paper were measured in the initial state (prior to the continuous operations) and after two thousand operations (after the continuous operations). The results are as shown in Table 3 below.

[EXAMPLE 14]

Using the same developing apparatus as that of the above-mentioned Example 1, the developing, the transferring and the fixing were carried out continuously two thousand times under the same conditions as those of the above-mentioned Example 1 with the exception that the developing apparatus was allowed to stand in an environment of a high temperature and a high humidity, i.e. at a temperature of 35° C. and a humidity of 85% for 12 hours, and thereafter the operations were carried out in the aforesaid environment. Then, the density ID of the image region and the density FD of the non-image region of the toner image fixed on a common paper were measured in the initial state (prior to the continuous operations) and after two thousand operations (after the continuous operations). The results are as shown in Table 3 below.

[EXAMPLE 15]

Continuous two thousand operations of the developing, the transferring and the fixing were carried out under the same conditions as those of the above-mentioned Example 14 with the exception of using, as the rigid member, an ordinary stainless steel plate used in the above-mentioned Example 8. Then, the density ID of the image region and the density FD of the non-image region of the toner image fixed on a common paper were measured in the initial state (prior to the continuous operations) and after two thousand operations (after the continuous operations). The results are as shown in Table 3 below.

TABLE 2

| | Surface roughness (Ra) | Coefficient of deflection | Amount of electric charge (μc/g) | | Density ID of image region | | Density FD of non-image region | |
|---|---|---|---|---|---|---|---|---|
| | | | Initial state | After 10,000 times | Initial state | After 10,000 times | Initial state | After 10,000 times |
| Example 10 | 0.01 | $1.18 \times 10^{-6}$ | 16.03 | 15.74 | 1.399 | 1.388 | 0.001 | 0.000 |
| Example 11 | 0.18 | $4.38 \times 10^{-7}$ | 13.21 | 10.91 | 1.408 | 1.409 | 0.001 | 0.003 |

TABLE 3

| | Surface roughness (Ra) | Coefficient of deflection | Environment | Density ID of image region | | Density FD of non-image region | |
|---|---|---|---|---|---|---|---|
| | | | | Initial state | After 2,000 times | Initial state | After 2,000 times |
| Example 12 | 0.01 | $1.18 \times 10^{-6}$ | Low temperature, low humidity | 1.375 | 1.382 | 0.002 | 0.002 |
| Example 13 | 0.18 | $4.38 \times 10^{-7}$ | Low temperature, low humidity | 1.373 | 1.389 | 0.003 | 0.00 |
| Example 14 | 0.01 | $1.18 \times 10^{-6}$ | High temperature, high humidity | 1.400 | 1.373 | 0.003 | 0.001 |
| Example 15 | 0.18 | $4.38 \times 10^{-7}$ | High temperature, high humidity | 1.171 | 1.357 | 0.010 | 0.002 |

It is recognized from the measurement results in Table 2 that there is no significant difference among the densities ID of the image region in an ordinary environment, but the density FD of the non-image region after continuous operations in the case where the rigid member is made of an ordinary stainless steel are somewhat greater than those in the case where the rigid member is made of a soda quartz glass (Nesa Glass) having an electrically conductive tin oxide thin film applied onto the surface thereof. However, the density FD value, 0.003, of the non-image region after the ten thousand operations is a practically acceptable value, and no fogging that is undesirable in practical use is produced.

Furthermore, it is recognized from the consideration of the measurement results shown in Table 3 that when the rigid member is made of ordinary stainless steel, the density FD of the non-image region becomes relatively high immediately after having been allowed to stand in the high-temperature and high-humidity environment and hence, so-called fogging tends to be formed, while when the rigid member is made of a soda quartz glass (Nesa Glass) having an electrically conductive tin oxide thin film applied onto the surface thereof, there can be obtained a sufficiently stable and good toner image even upon such a change in the environment.

In the apparatus for developing an electrostatic latent image according to the present invention, the amount of the developing agent held on the surface of the developing agent application means is limited to become very uniform and very stable in the direction of width as desired owing to the action of the limiting means that includes the rigid member. The rigid member of the limiting means is produced at a sufficiently low cost and can be stably used for extended periods of time.

Though a preferred embodiment of the present invention was described above in detail with reference to the accompanying drawings, it should be noted that the invention is in no way limited to the above embodiment only but can be varied or modified in a variety of other ways without departing from the scope of the invention.

What we claim is:

1. An apparatus for developing an electrostatic latent image, which comprises:

a developing agent application means which holds developing agent on the surface thereof in a developing agent-holding zone and carries the developing agent into a developing zone to apply the developing agent onto the electrostatic latent image;

and a limiting means which limits the amount of the developing agent held on the surface of said developing agent application means in a developing agent-limiting zone located between said developing agent-holding zone and said developing zone; wherein said limiting means is constituted by a rigid member and includes one surface that is brought into forced contact with the surface of said developing agent application means, and wherein a region on one surface of said rigid member that is at least forcibly contacted to the surface of said developing agent application means has a surface roughness Ra of 6.00 or smaller.

2. An apparatus for developing an electrostatic latent image according to claim 1, wherein a free end of said rigid member protrudes toward the upstream side as viewed in a direction in which said developing agent application means moves.

3. An apparatus for developing an electrostatic latent image according to claim 2, wherein the length of protrusion of the free end of said rigid member is from 0.5 to 4.0 mm.

4. An apparatus for developing an electrostatic latent image according to claim 3, wherein the length of protrusion of the free end of said rigid member is from 0.8 to 3.5 mm.

5. An apparatus for developing an electrostatic latent image according to claim 4, wherein the length of protrusion of the free end of said rigid member is from 1.0 to 2.0 mm.

6. An apparatus for developing an electrostatic latent image according to claim 1, wherein the region on one surface of said rigid member that is at least forcibly contacted to the surface of said developing agent application means has a surface roughness Ra of 0.20 or smaller.

7. An apparatus for developing an electrostatic latent image according to claim 6, wherein the region on one surface of said rigid member that is at least forcibly contacted to the surface of said developing agent application means has a surface roughness Ra of 0.02 or smaller.

8. An apparatus for developing electrostatic latent image according to claim 1, wherein one surface of said rigid member is defined by one surface of a sheet of glass.

9. An apparatus for developing an electrostatic latent image according to claim 8, wherein an electrically conducting film is applied to the one surface of said sheet of glass.

10. An apparatus for developing an electrostatic latent image according to claim 1, wherein one surface of said rigid member is defined by one surface of a stainless steel plate.

11. An apparatus for developing an electrostatic latent image according to claim 1, wherein one surface of said rigid member is brought into forced contact with said developing agent application means at a line pressure of from 10 to 80 g/cm.

12. An apparatus for developing an electrostatic latent image according to claim 11, wherein one surface of said rigid member is brought into forced contact with said developing agent application means at a line pressure of from 20 to 70 g/cm.

13. An apparatus for developing an electrostatic latent image according to claim 12, wherein one surface of said rigid member is brought into forced contact with said developing agent application means at a line pressure of from 40 to 60 g/cm.

14. An apparatus for developing an electrostatic latent image according to claim 1, wherein said developing agent consists of only toner having a volume average grain size of from 8.0 to 12.0 μm.

15. An apparatus for developing an electrostatic latent image according to claim 1, wherein said developing agent application means is constituted by a solid synthetic rubber roller having an Asker's C hardness of from 45 to 65.

16. An apparatus for developing an electrostatic latent image according to claim 15, wherein said solid synthetic rubber roller is brought into forced contact with the surface of an electrostatic latent image carrier on which is formed an electrostatic latent image that is to be developed in said developing zone, and said solid synthetic rubber roller is elastically compressed by about 0.05 to about 0.15 mm.

17. An apparatus for developing an electrostatic latent image according to claim 16, wherein the surface of said electrostatic latent image carrier and the surface of said solid synthetic rubber roller are moved in the same direction in said developing zone, and a relationship $1.5\ V1 \leqq V2 \leqq 2.2\ V1$ is established between a moving speed V1 of the surface of said electrostatic latent image carrier and a moving speed V2 of the surface of said solid synthetic rubber roller.

18. An apparatus for developing an electrostatic latent image according to claim 15, wherein an auxiliary roller made of a foamed material is disposed to come into forced contact with the surface of said solid synthetic rubber roller in said developing agent-holding zone, and is elastically compressed by 0.15 to 0.25 mm upon being brought into forced contact with the surface of said solid synthetic rubber roller, the surface of said solid synthetic rubber roller and the surface of said auxiliary roller are moved in opposite directions relative to each other in said developing agent-holding zone, and a relationship $0.4\ V2 \leqq V3 \leqq 1.8\ V2$ is established between a moving speed V2 of the surface of said solid synthetic rubber roller and a moving speed V3 of the surface of said foamed material roller.

19. An apparatus for developing an electrostatic latent image, which comprises:

a developing agent application means which holds developing agent on the surface thereof in a developing agent-holding zone and carries the developing agent into a developing zone to apply the developing agent onto the electrostatic latent image;

and a limiting means which limits the amount of the developing agent held on the surface of said developing agent application means in a developing agent-limiting zone located between said developing agent-holding zone and said developing zone; wherein said limiting means is constituted by a rigid member and includes one surface that is brought into forced contact with the surface of said developing agent application mean, and wherein a free end of said rigid member protrudes toward the upstream side as viewed in a direction in which said developing agent application means moves, and the length of protrusion of the free end of said rigid member is from 0.5to 4.0 mm.

20. An apparatus for developing an electrostatic latent image, which comprises:

a developing agent application means which holds developing agent on the surface thereof in a developing agent-holding zone and carries the developing agent into a developing zone to apply the developing agent onto the electrostatic latent image;

and a limiting means which limits the amount of the developing agent held on the surface of said developing agent application means in a developing agent-limiting zone located between said developing agent-holding zone and said developing zone; wherein said limiting means is constituted by a rigid member and includes one surface that is brought into forced contact with the surface of said developing agent application means, and wherein one surface of said rigid member is defined by one surface of a sheet of glass.

21. An apparatus for developing an electrostatic latent image, which comprises:

a developing agent application means which holds developing agent on the surface thereof in a developing agent-holding zone and carries the developing agent into a developing zone to apply the developing agent onto the electrostatic latent image;

and a limiting means which limits the amount of the developing agent held on the surface of said developing agent application means in a developing agent-limiting zone located between said developing agent-holding zone and said developing zone; wherein said limiting means is constituted by a rigid member and includes one surface that is brought into forced contact with the surface of said developing agent application means at a line pressure of from 10 to 80 g/cm.

22. An apparatus for developing an electrostatic latent image according to claim 21, wherein a region on one surface of said rigid member that is at least forcibly contacted to the surface of said developing agent application means has a surface roughness Ra of 6.00 or smaller.

23. An apparatus for developing an electrostatic latent image, which comprises:

a developing agent application means which holds developing agent on the surface thereof in a developing agent-holding zone and carries the developing agent into a developing zone to apply the developing agent onto the electrostatic latent image;

and a limiting means which limits the amount of the developing agent held on the surface of said developing agent application means in a developing agent-limiting zone located between said developing agent-holding zone and said developing zone; wherein said limiting means is constituted by a rigid member and includes one surface that is brought into forced contact with the surface of said developing agent application means, and wherein said developing agent consists of only toner having a volume average grain size of from 8.0 to 12.0 μm.

* * * * *